US005855383A

United States Patent [19]

Harr et al.

[11] Patent Number: 5,855,383

[45] Date of Patent: Jan. 5, 1999

[54] IN-LINE ROLLER SKATE WITH INTERCEPTION OF VIBRATIONS

[75] Inventors: Robert D. Harr, Arvada, Colo.; Antonello Marega, Treviso, Italy; Andrea Gabrielli, Trento, Italy

[73] Assignee: Tecnica SPA, Treviso, Italy

[21] Appl. No.: 727,044

[22] Filed: Oct. 8, 1996

[30] Foreign Application Priority Data

Oct. 18, 1995 [IT] Italy ..... TV95A 0121

[51] Int. Cl.[6] ..... A63C 17/00

[52] U.S. Cl. ..... 280/11.22; 36/113

[58] Field of Search ..... 280/11.19, 11.22, 280/11.23, 11.27; 36/87, 92, 96, 113, 114, 3 B, 43, 44

[56] References Cited

U.S. PATENT DOCUMENTS

| | | | |
|---|---|---|---|
| 5,203,793 | 4/1993 | Lyden | 36/43 |
| 5,554,694 | 9/1996 | Grow | 36/44 |
| 5,678,833 | 10/1997 | Olson et al. | 280/11.22 |
| 5,709,954 | 1/1998 | Lyden et al. | 36/114 |

FOREIGN PATENT DOCUMENTS

| | | |
|---|---|---|
| 0 570 048 | 11/1993 | European Pat. Off. . |
| 2 627 961 | 9/1989 | France . |
| 602 148 | 7/1978 | Switzerland . |
| 649 472 | 5/1985 | Switzerland . |
| 93/12847 | 7/1993 | WIPO . |
| 95/03101 | 2/1995 | WIPO . |

*Primary Examiner*—Richard M. Camby
*Attorney, Agent, or Firm*—Griffin, Butler, Whisenhunt & Szipl, LLP

[57] ABSTRACT

By interposing between the roller-carrying frame of an in-line roller skate and a rigid plate positioned inside the shoe an insert of elastomeric material having lugs projecting upwards and passing through the sole of the shoe, vibrations and bumps caused by the running of the rollers on the ground are intercepted and damped.

7 Claims, 5 Drawing Sheets

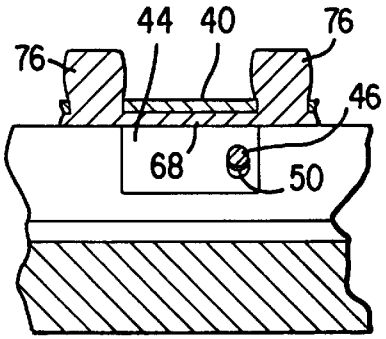
FIG. 6A
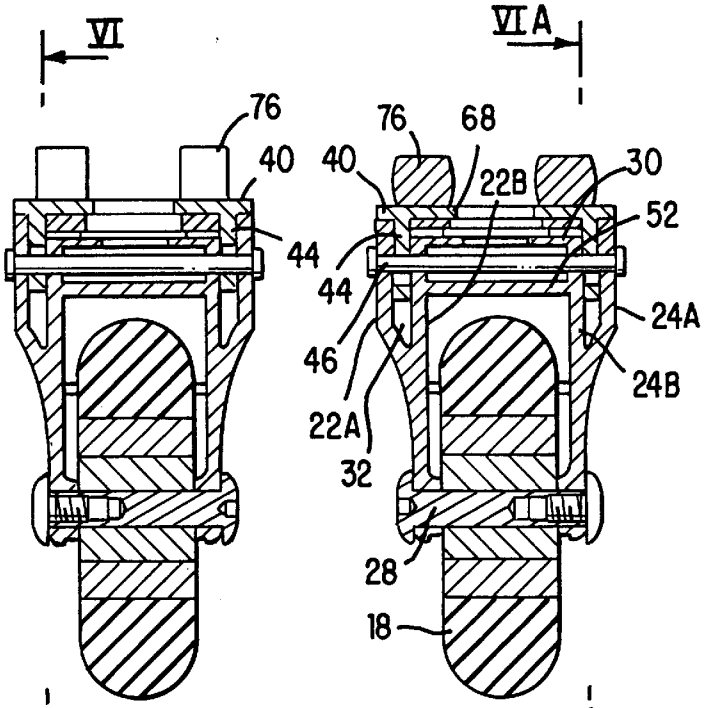
FIG. 5A
FIG. 5
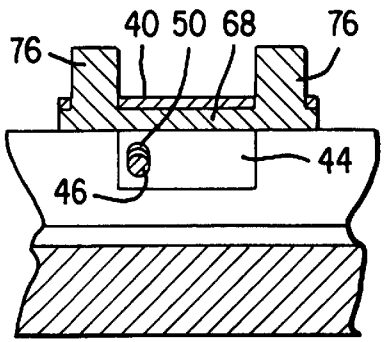
FIG. 6

IN-LINE ROLLER SKATE WITH INTERCEPTION OF VIBRATIONS

The present invention relates to roller skates of the so-called in-line roller type and more especially to an improvement in the structure of these skates which eliminates the transmission of vibrations to the skater's lower limbs. Naturally, the invention is not limited to this type of skate but can also be used in conventional skates having two pairs of rollers ice skates and also similar sports equipment. Therefore the term "rollers" characterises the rolling elements of the skate. In recent years, roller skates having a certain number of rollers (usually four or five) aligned along the longitudinal axis of the skate have become increasingly widespread, which is why the similarity to bladed skates used for ice skating has become more marked.

It is not necessary here to underline the differences in performance which distinguish this form of roller skate, the structure of which basically comprises a shoe or ankle boot of which the sole is secured to a roller-carrying frame to which, in their turn, the skating rollers and optionally a front or rear rubber pad brake are secured. With this structure, any unevenness in the running surface results in a stress which is transmitted directly to the skater's foot and thus to his lower limb. It should be noted that the practice of skating with this type of skate imposes more fatigue and strain on the skater since a specific effort for maintaining balance, comparable to that required for ice skating, is added to the usual effort necessary to advance and turn.

When the ground or running surface has irregularities or areas of roughness which are substantial in number and frequency but which are of minimum height, their effect on the skate, and thus on the skater's limb, consists in high-frequency vibrations which in turn lead to substantial tiring of the lower limbs which are already subjected to not inconsiderable strain for the reasons explained above. The simple interposition of pads of resilient or elastomeric material, such as rubber, between the sole of the shoe and the roller-carrying frame does not solve the problem, principally for two reasons:

a) a structure of this type can damp the knocks or bumps to which the wheels of the skate may be subjected, for example when the running surface has holes or other rough and unexpected irregularities, but cannot damp the vibrations, and above all it cannot prevent either the bumps or the vibrations from being transmitted to the skater's limb;

b) if the rubber plate or pad is not clamped very tightly between these two above-mentioned portions of the skate in order to prevent the sole, and therefore the shoe, from having excessive lateral freedom, there is a possibility of serious injury, especially to the skater's ankles, and above all the immediacy of the transmission of commands from the skater's foot to the skate is reduced.

The principal aim of the present invention is substantially to solve the problems and disadvantages mentioned briefly above and, especially, to provide an in-line roller skate provided with means capable of absorbing vibrations and bumps caused by the running of the rollers on the running surface, substantially preventing the transmission thereof to the shoe and thus to the skater's lower limb.

Another aim of the present invention is to provide an in-line roller skate in which the presence of the means for absorbing vibrations and bumps is not to the detriment of the skate's performance, especially as regards manoeuvrability and turning capacity. Yet another aim of the present invention is to provide an in-line roller skate provided with the above-mentioned means which can be manufactured and repaired in a simple and industrially advantageous manner.

These aims are achieved substantially with the in- line roller skate according to the present invention, of the type comprising a shoe or ankle boot provided with a sole, a roller-carrying frame having an upper surface secured rigidly to the lower face of the sole and in-line rollers which are aligned along the longitudinal axis of the skate and which are mounted on the frame by means of hubs so that they can rotate freely, characterised in that the ankle boot contains, above the internal face of the sole, a flat and rigid insole on which the skater's foot rests, and an insert of elastomeric material which is mounted between the roller-carrying frame and the flat and rigid insole such that at least a portion of the insert passes through the sole so that it is in contact with the lower face of the flat and rigid insole.

According to a preferred embodiment of the present invention, the insert of elastomeric material is secured to the roller-carrying frame by means of an intermediate element which is provided with at least one pair of flanges which can be connected to a corresponding cavity formed in the frame, the securing of the intermediate element to the frame being carried out by means of a through-pin which engages in elongate slots formed in the flanges of the intermediate element in such a manner as to ensure a limited mobility in the vertical direction of the intermediate element relative to the frame, and thus a programmed delay of the transmission of the stresses to the elastomeric element and to the shoe.

As will be appreciated from the following detailed description of a preferred embodiment of the present invention, the absorption of the vibrations and bumps according to the present invention is effected owing to the fact that the skater's foot rests directly, or by way of an insole, on one or more flat and rigid elements which are anchored in a non-rigid manner to the sole of the shoe or ankle boot, and which are in their turn in direct contact with an elastomeric insert, at least one projecting portion of which passes through the sole of the shoe, the elastomeric insert also being secured permanently to the roller-carrying frame of the skate.

The absorption of the vibrations is further promoted and increased owing to the fact that the elastomeric insert is mounted between the upper surface of the roller-carrying frame and the above-mentioned flanged intermediate element, and in particular by virtue of the play provided between the intermediate element and the frame.

As a matter of fact it seems that, (it having however not to be construed as an undue limitation), the elastomeric material that is mounted between the frame and the upper flanged surface is intended to absorb the higher frequency vibrations (that cause loss of feeling and numbness) while the towers that extend through the shell and support the rigid insole are intended to absorb the lower frequency vibrations that cause fatigue and stress in the lower limbs.

Tests carried out have in fact demonstrated that, with the skate structure according to the present invention, the vibrations generated in the rollers, and thus in the frame supporting it, are substantially absorbed by the insert of elastomeric material without being transmitted to the skater's foot, and without in any way reducing functionality and the speed of transmission of commands from the skater's foot to the skate.

In the appended drawings, which refer to the above-mentioned preferred embodiment of the skate according to the invention:

FIG. 5 is a sectional view of the sectional plane V—V of FIG. 2;

FIG. 6 is an enlarged and partially sectional view of the sectional plane VI-VI of FIG. 5;

FIGS. 4A, 5A and 6A are views analogous to FIGS. 4, 5 and 6 with the skate in the operative and stressed state.

Figure 1:
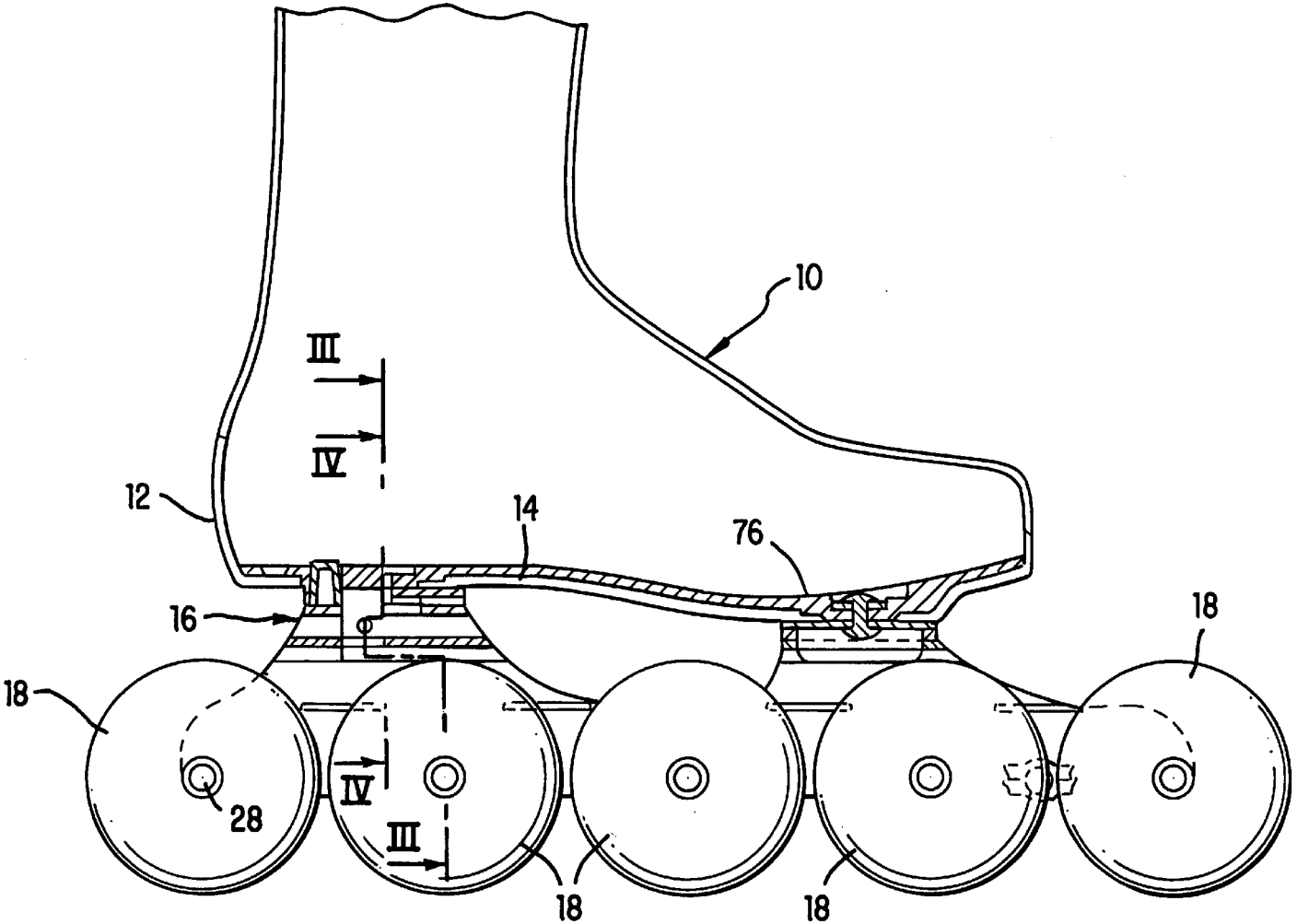
FIG. 1 is a partial view in longitudinal section of an in-line roller skate according to the present invention.

Referring first of all to FIG. 1, the skate according to the invention comprises a shoe or ankle boot 10 which has a structure and features known per se and which it is not necessary to describe in more detail, except for the fact that it has an external shell 12 (not shown in its entirety) which is preferably rigid and which has a lower sole 14 which is to be secured to a frame 16 on which the running rollers 18 (of which there are five in the model shown) are mounted.

A pad brake (not shown) usually completes the structure of the skate.

Figure 2:
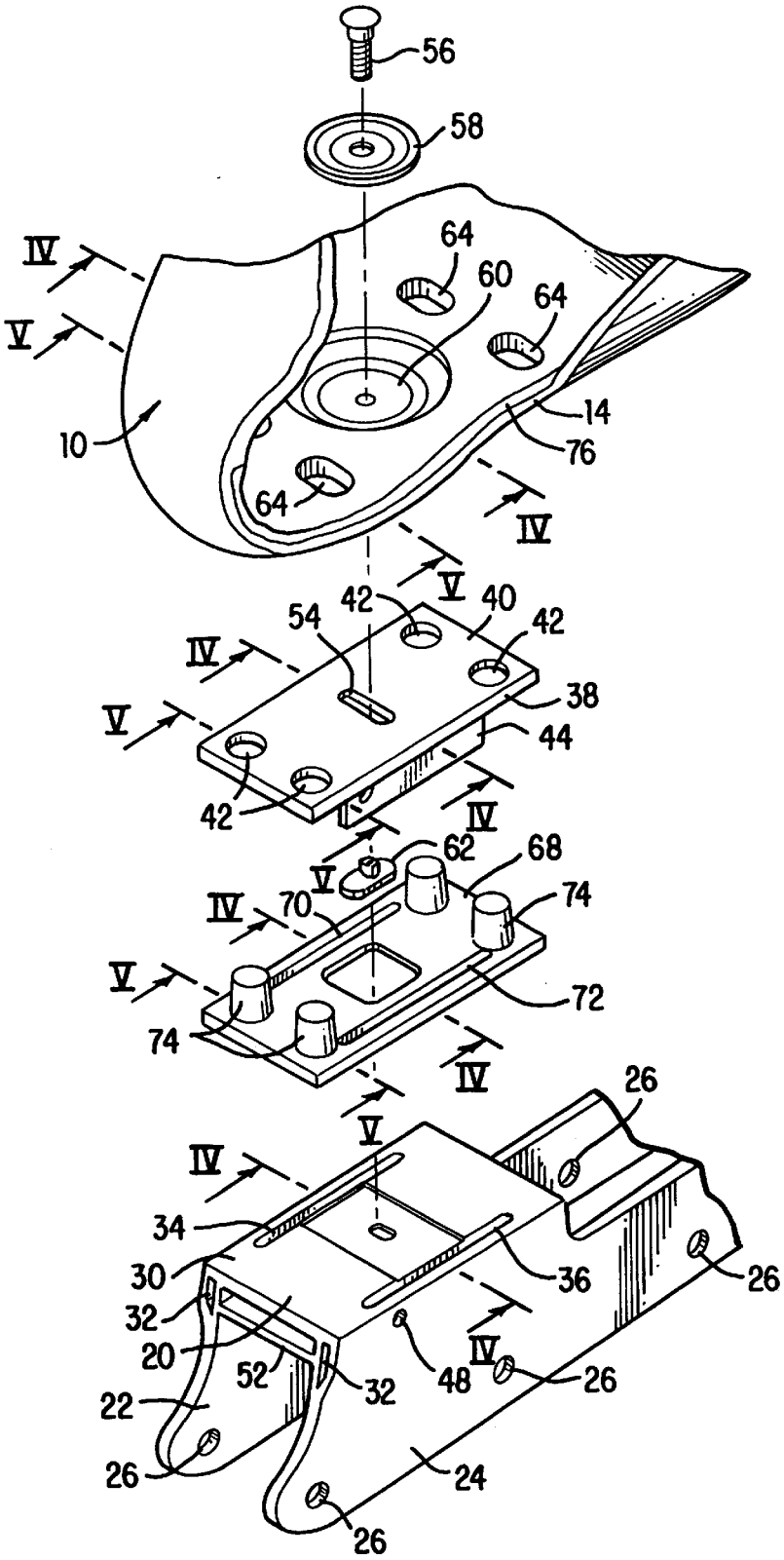
FIG. 2 is a partial exploded view of the structure of the skate according to the invention.
Figure 4A:
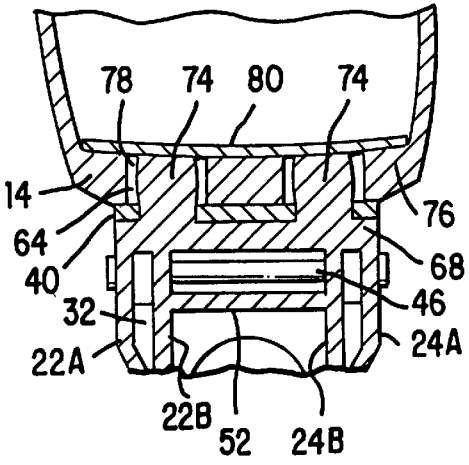
Figure 4:
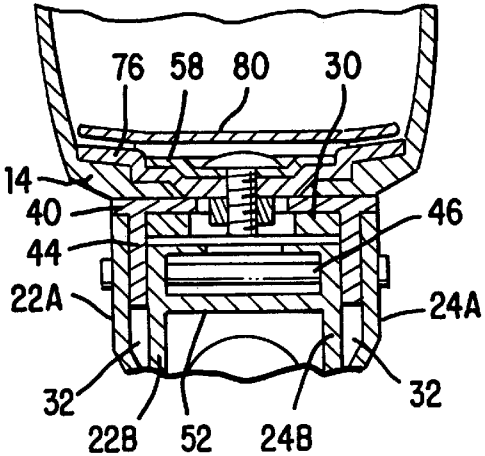
FIG. 4 is a partially sectional view of the sectional plane IV—IV of FIGS. 1 and 2 which shows the structure forming the subject-matter of the invention in more detail.
Figure 3:
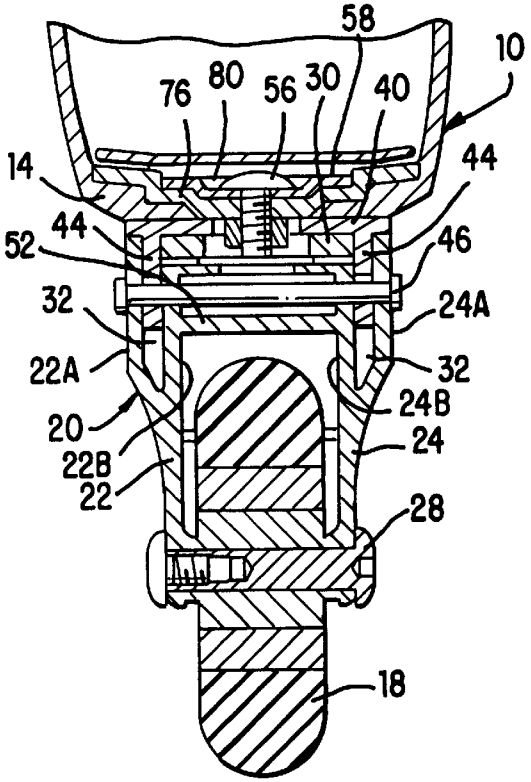
FIG. 3 is a sectional view of the sectional plane II—III of FIG. 1.
Figure 7:
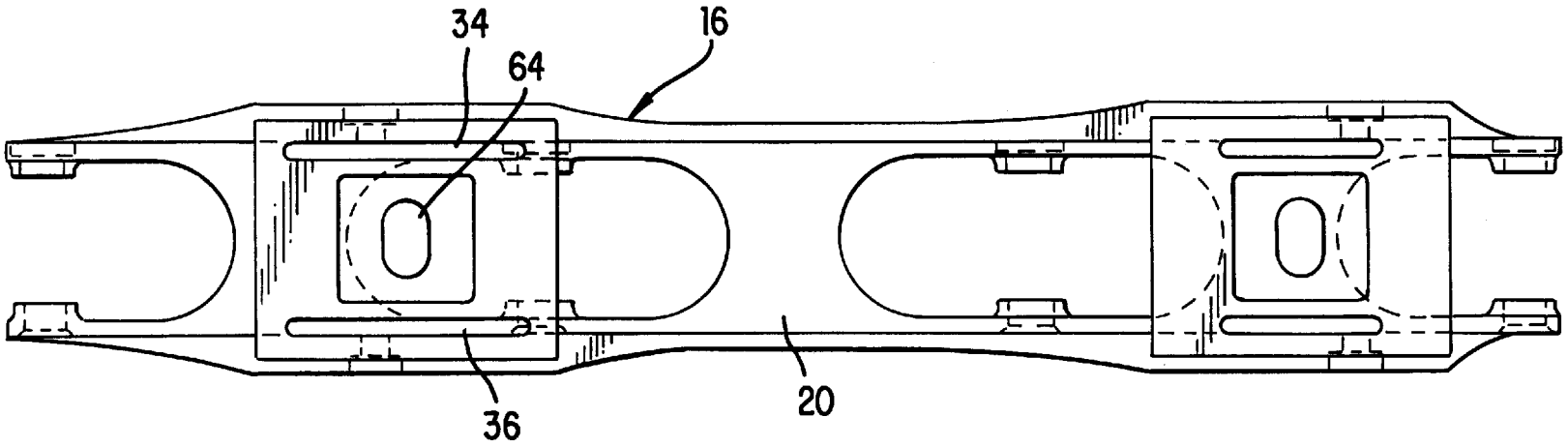
FIG. 7 is a top view of the roller-carrying frame.

It should be noted that, in the preferred embodiment, the ankle boot 10 is constructed analogously to a ski boot in the sense that it comprises a rigid shell, at least at its lower portion, completed at the top by a shaft portion which is hinged to the shell and can be opened in order to permit the introduction of the foot which may be enclosed in a soft light shoe for protection and comfort The roller-carrying frame 16, as is shown more clearly in FIGS. 2 and 7, comprises a body 20 which is substantially in the shape of an inverted U, and therefore has two side wings 22 and 24 (the two sides of the U) provided with aligned and opposing holes 26 which are used to mount the engaging hubs 28 of the rollers 18.

The two wings 22 and 24 of the frame 16 are divided in the area of attachment to the horizontal side 30 (corresponding to the horizontal side of the above-mentioned U) to form two parallel cavities 32, therefore defined by the walls 22*a*, 22*b* and 24*a*, 24*b* of the wings 22 and 24.

The horizontal side 30 of the frame 16 has (as shown in FIG. 2) two slits or slots 34, 36 which are offset towards the centre of the frame relative to the walls 24*a* and 24*b* forming the cavities 32, so that the slots 34, 36 are aligned vertically with the cavity 32. The ankle boot 10 is secured to the frame 16 by means of a small flanged plate 38 precisely comprising a plate portion 40 provided with four holes 42 and with a pair of flanges 44 which can pass through the pairs of slots 34 and 36 and which are received in the respective cavities 32.

A pin 46 is used to lock the small flanged plate 38 to the frame 16 (as shown especially in FIGS. 3 to 6).

More especially, as is shown clearly in the Figures, the pin 46 engages through-holes 48 formed in the walls 22*a*, 22*b* and 24*a*, 24*b*.

However, as regards the flanges 44, the holes 50 through which the pins 46 pass are in the form of a slot having a substantially vertical axis. Consequently, the pin 46 is housed in the slot 50 with a certain amount of play, which is permitted by the coupling between the flange 44 and the slot 34, 36 and which can be appreciated by comparing FIGS. 6 and 6A, which show the skate in the inactive state and in the use state.

It will therefore be appreciated that, with this play, the small flanged plate 38 and the shoe 10 which is integral therewith are not connected rigidly to the roller-carrying frame 16. A flat stiffening rib 52 is also formed between the two inner walls 22*b*, 24*b* of the frame 20 in order to increase mounting rigidity.

The plate portion 40 also has a central hole 54 which is slot-shaped for the purposes of regulation and flexibility of use and which is used to attach the small flanged plate 38 rigidly to the sole 14 of the ankle boot by means of a through-screw 56 which engages with a washer 58, which is in its turn housed in a hole 60 formed in the sole 14, and a lock nut 62.

In addition, in correspondence with the four peripheral holes 42 of the plate portion 40, the sole 14 of the shoe 10 has identical through-openings 64 in order to permit communication between the internal and external faces of the sole 14.

An insert 66 produced from elastomeric material, such as rubber (natural or synthetic) or from a thermoplastic elastomer, of which the resilience or rigidity is fixed as a function of the desired degree of absorption of vibrations and bumps, is mounted between the upper surface of the horizontal side 30 of the roller-carrying frame 16 and the internal face of the small flanged plate 38.

As is shown clearly in FIG. 2, the insert 66 is composed of a sheet portion 68 having a pair of slits or slots 70 and 72 which are aligned vertically with and co-extend with the slits 34, 36 in the upper horizontal portion 30 of the frame 16 in order, as will be appreciated, to permit the insertion of the flanges 44 of the small flanged plate 38.

Formed in the area of the comers of the sheet 68, preferably in one piece therewith, are substantially frusto-conical lugs or projections 74 of a diameter suitable for passing through the above-mentioned holes 42 formed in the small plate 38, as well as through the holes 64 formed in the sole 14 of the shoe- until they project by a predetermined distance through the sole into the shoe 10.

In the embodiment illustrated in the drawings, it will be noted that a counter-sole 76 which also has holes 78 corresponding to the holes 64 is secured to the internal face of the sole 14 in such a manner that the upper ends of the lugs 74 also project through the countersole 76.

Above the counter-sole 76 is a element or thin sheet 80 of substantially rigid material against which the upper ends of the lugs 74 rest. For example, the element 80 may be the customary "packing" generally adopted in boots. The mounting structure described above is naturally also repeated in the front portion of the frame 16, since the mounting of the shoe on the roller-carrying frame is normally effected in two positions.

A comparison between FIGS. 4 and 4A, 5 and 5A and 6 and 6A clearly shows the behavior of the roller skate when it is loaded and stressed, and especially the cooperation which is established between the elastomeric lugs 74 and the insole 80, as well as between the mounting pins 46 and the slots 50.

It will be appreciated from the above description that any vibration of the rollers 18 caused, for example, by corrugated or uneven ground is transmitted as far as the inserts 66 but is not transmitted to the skater's foot owning to the intercepting effect resulting from contact between the lugs 74 and the rigid sheet 80, as well as the vertical displacement of surface 30 allowed by the compression feature 68 between surface 30 and surface 40.

At the same time,the fastening shoe to the roller-carrying frame, although effected with a certain amount of play, ensures that the commands given by the skater via the lower limbs, the ankle boots and the attachment to the roller-carrying frame are transmitted accurately and immediately.

Finally, it will be understood that any structurally or mechanically equivalent modifications and variations are possible within the scope of the present invention and that such modifications are likewise to be included.

We claim:

1. In-line roller skate of the type comprising a shoe or ankle boot (10) provided with a sole (14), a roller-carrying frame (16) having an upper surface secured to the lower face of the sole and in-line rollers (18) which are aligned along the longitudinal axis of the skate and which are mounted on the frame by means of hubs so that they can rotate freely, characterised in that the ankle boot contains, above the internal face of the sole—a rigid insole (80) on which the skater's foot rests, and an insert (66) of elastomeric material which is mounted between the roller-carrying frame and the insole (80) such that at least a portion of the insert (66) passes through the sole so that it is in contact with the lower face of the flat and rigid insole (80).

2. Roller skate according to claim 1, characterised in that the insert (66) comprises a sheet (68) of elastomeric material from which four lugs (74) arranged at the corners of the sheet project upwards, being housed in the same number of through-holes (64) formed in the sole (14) and being of a height such that they project above the internal surface of the sole (14) and are supported on and are in contact with the lower surface of the flat and rigid insole (80), the sheet also being provided with a pair of slots or slits (70, 72) parallel to the, longitudinal axis of the skate.

3. Roller skate according to claim 2, characterised in that a counter-sole (76) covers the internal face of the sole and the height of the lugs (74) is such that they project through corresponding holes (78) formed in the counter-sole.

4. Roller skate according to claim 1, characterised in that a small flanged mounting plate (38) is provided between the insert (66) and the lower face of the sole (14) and comprises a flat plate element (40) having four through-holes (42) at the corners and a central through-hole (54), at least one pair of flanges (44) which are symmetrical relative to the longitudinal axis of the small flanged plate (38) projecting at right- angles from the lower face of the flat plate element (40).

5. Roller skate according to claim 1, characterised in that the roller-carrying frame (16) is in the shape of an inverted U formed by two side walls or wings (22, 24) and by a horizontal side (30), the side walls being provided with aligned and opposed holes (26) for mounting the pins (28) of the rollers (18) and having, in the area of attachment to the horizontal wall (30), a second wall **(22*b*, 24*b*) parallel to the first (22*a*, 24*a*) so as to form a vertical cavity (32), at least one pair of slots or slits (34, 36) parallel to the longitudinal axis of the skate being formed in the horizontal wall (30) so that the flanges (44) of the small flanged plate (38) seat in the cavities (32) by passing through the slots (34, 36) of the horizontal wall (30) and the slots (70, 72) of the elastomeric insert, since the elastomeric insert (66) is positioned between the upper face of the horizontal wall (30) and the flanged lower face of the small flanged plate (38)**.

6. Roller skate according to claim 5, characterised in that a rib (52) is inserted between the internal faces of the wall **(22*b*, 24*b*)**.

7. Roller skate according to claim 5, characterised in that a mounting pin (46) is inserted transversely into corresponding and aligned through-holes (48, 50) which are formed, respectively, in the side walls **(22*a*, 24*a*, 22*b*, 24*b*) of the frame (16) and in the downwardly projecting flanges (44) of the small flanged plate (38), the holes (50) being shaped in the form of slots having a vertical axis in order to permit a predetermined amount of play between the pin (46) and the slots or holes (50)**.

* * * * *